US012180789B2

(12) United States Patent
Amezaga

(10) Patent No.: US 12,180,789 B2
(45) Date of Patent: Dec. 31, 2024

(54) SPIDERS CAPABLE OF HANDLING WELL COMPONENTS OF MULTIPLE SIZES

(71) Applicant: WEATHERFORD TECHNOLOGY HOLDINGS, LLC, Houston, TX (US)

(72) Inventor: Federico Amezaga, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 20 days.

(21) Appl. No.: 17/760,208

(22) PCT Filed: Mar. 4, 2021

(86) PCT No.: PCT/US2021/020932

§ 371 (c)(1),
(2) Date: Aug. 5, 2022

(87) PCT Pub. No.: WO2021/194720

PCT Pub. Date: Sep. 30, 2021

(65) Prior Publication Data

US 2023/0053471 A1 Feb. 23, 2023

Related U.S. Application Data

(60) Provisional application No. 62/994,000, filed on Mar. 24, 2020.

(51) Int. Cl.
*E21B 19/10* (2006.01)
*E21B 19/24* (2006.01)

(52) U.S. Cl.
CPC ..... *E21B 19/10* (2013.01); *E21B 19/24* (2013.01)

(58) Field of Classification Search
CPC ..... E21B 19/10; E21B 19/24
See application file for complete search history.

(56) References Cited

U.S. PATENT DOCUMENTS 2,623,257 A 12/1952 Moon
2,969,702 A 1/1961 Cornish et al.
(Continued)

FOREIGN PATENT DOCUMENTS

AU 2009212960 A1 3/2010
WO 2004011765 A1 2/2004
WO 2014179732 A2 11/2014

OTHER PUBLICATIONS

International Search Report with Written Opinion issued Jul. 23, 2021 for PCT Patent Application No. PCT/US2021/020932, 19 pages.

(Continued)

*Primary Examiner* — Tara Schimpf
*Assistant Examiner* — Jennifer A Railey
(74) *Attorney, Agent, or Firm* — Smith IP Services, P.C.

(57) ABSTRACT

A spider for handling/gripping well components of various sizes can include multiple slip assemblies distributed circumferentially about a central axis, each slip assembly including a slip carrier radially displaceable relative to the central axis, a slip displaceable relative to the slip carrier, and a slip actuator operable to displace the slip relative to the slip carrier, the slip actuator being disposed at least partially internal to the slip carrier. Each slip assembly may include a slip carrier actuator that radially displaces the slip carrier. A table assembly may mount to a well rig with an upper surface of the table assembly being flush with a rig floor of the well rig. Another spider can include a pipe guide assembly with multiple guides and guide actuators. Each guide actuator rotates a respective one of the pipe guides about a respective guide axis that is parallel to the central axis.

20 Claims, 14 Drawing Sheets

(56) References Cited

U.S. PATENT DOCUMENTS

| | | | | |
|---|---|---|---|---|
| RE27,724 | E * | 8/1973 | Johnson | E21B 19/10 188/67 |
| 4,269,277 | A | 5/1981 | Baugh | |
| 6,089,338 | A | 7/2000 | Bouligny, Jr. | |
| 6,450,385 | B1 | 9/2002 | Guerin | |
| 6,920,931 | B1 * | 7/2005 | Webre | E21B 19/22 166/77.1 |
| 7,267,168 | B1 | 9/2007 | Sipos | |
| 7,419,000 | B1 | 9/2008 | Marsh | |
| 8,020,627 | B2 | 9/2011 | Shahin et al. | |
| 8,322,436 | B2 | 12/2012 | Maa | |
| 8,752,636 | B2 | 6/2014 | Liess et al. | |
| 9,068,404 | B2 | 6/2015 | Angelle et al. | |
| 9,347,282 | B1 | 5/2016 | Sipos | |
| 9,500,047 | B2 | 11/2016 | Brown et al. | |
| 9,546,525 | B2 | 1/2017 | Mosing et al. | |
| 9,598,918 | B2 | 3/2017 | Mcintosh et al. | |
| 9,702,206 | B2 | 7/2017 | Angelle et al. | |
| 10,036,215 | B2 | 7/2018 | Wood | |
| 10,053,932 | B2 | 8/2018 | Sipos | |
| 10,233,704 | B2 | 3/2019 | Bouligny et al. | |
| 10,329,893 | B2 | 6/2019 | Smith | |
| 10,487,597 | B2 | 11/2019 | Stankovic | |
| 10,513,894 | B2 | 12/2019 | Abou-Assaad et al. | |
| 2014/0360736 | A1 * | 12/2014 | Angelle | E21B 19/10 166/381 |
| 2015/0090463 | A1 * | 4/2015 | Gupta | E21B 19/10 166/382 |
| 2015/0107857 | A1 * | 4/2015 | Mosing | E21B 19/10 166/382 |
| 2017/0058619 | A1 | 3/2017 | Shepperd et al. | |
| 2018/0051526 | A1 | 2/2018 | Zouhair | |
| 2018/0283112 | A1 | 10/2018 | Abou-Assaad et al. | |

OTHER PUBLICATIONS

Australian Examination Report issued Oct. 20, 2022 for AU Patent Application No. 2021244291, 3 pages.

European Communication pursuant to Rules 161(1) and 162 EPC for EP Patent Application No. 21715031.7, dated Nov. 2, 2022, 3 pages.

National Oilwell Varco; Bottom Hole Assembly Tool (BHAT), company article No. D392005317-MKT-001 Rev. 02, dated 2014, 4 pages.

National Oilwell Varco; "Power Slips", Rotary & Handling Tools Catalog 2018 Land & Offshore, dated Apr. 12, 2018, 14 pages.

Cavins Oil Well Tools; "Cavins 'Advanced' Automatic Spiders", company article, dated 2012, 32 pages.

Brazilian Office Action issued May 9, 2023 for BR Patent Application No. BR112022016864-0, 5 pages.

English translation of Brazilian Office Action issued May 9, 2023 for BR Patent Application No. BR112022016864-0, 9 pages.

Mexican Office Action issued Aug. 17, 2023 for MX Patent Application No. MX/a/2022/010337, 3 pages.

English Translation of Mexican Office Action issued Aug. 17, 2023 for MX Patent Application No. MX/a/2022/010337, 3 pages.

* cited by examiner

SPIDERS CAPABLE OF HANDLING WELL COMPONENTS OF MULTIPLE SIZES

CROSS-REFERENCE TO RELATED APPLICATIONS

This application is a national stage under 35 USC 371 of International Application No. PCT/US21/20932, filed on 4 Mar. 2021, which claims the benefit of the filing date of U.S. Provisional Application No. 62/994,000, filed on 24 Mar. 2020. The entire disclosures of these prior applications are incorporated herein by this reference.

TECHNICAL FIELD

This disclosure relates generally to equipment utilized and operations performed in conjunction with a subterranean well and, in examples described below, more particularly provides a spider usable with multiple well component sizes.

BACKGROUND

A "spider" is a type of equipment used in well pipe handling operations to grip and suspend a well component above a borehole. A spider may be used with various types of well components, such as, tubular strings (e.g., drill pipe, tubing, casing, etc.), bottom hole assemblies (which may in various examples include logging tools, drilling motors, drill collars, stabilizers, reamers, etc.) and other well equipment. A spider typically includes multiple gripping elements (known to those skilled in the art as "slips") arranged in a radial array.

Therefore, it will be readily appreciated that improvements are continually needed in the art of designing, constructing and utilizing spiders. The present specification provides such improvements to the art.

DETAILED DESCRIPTION

Figure 1:
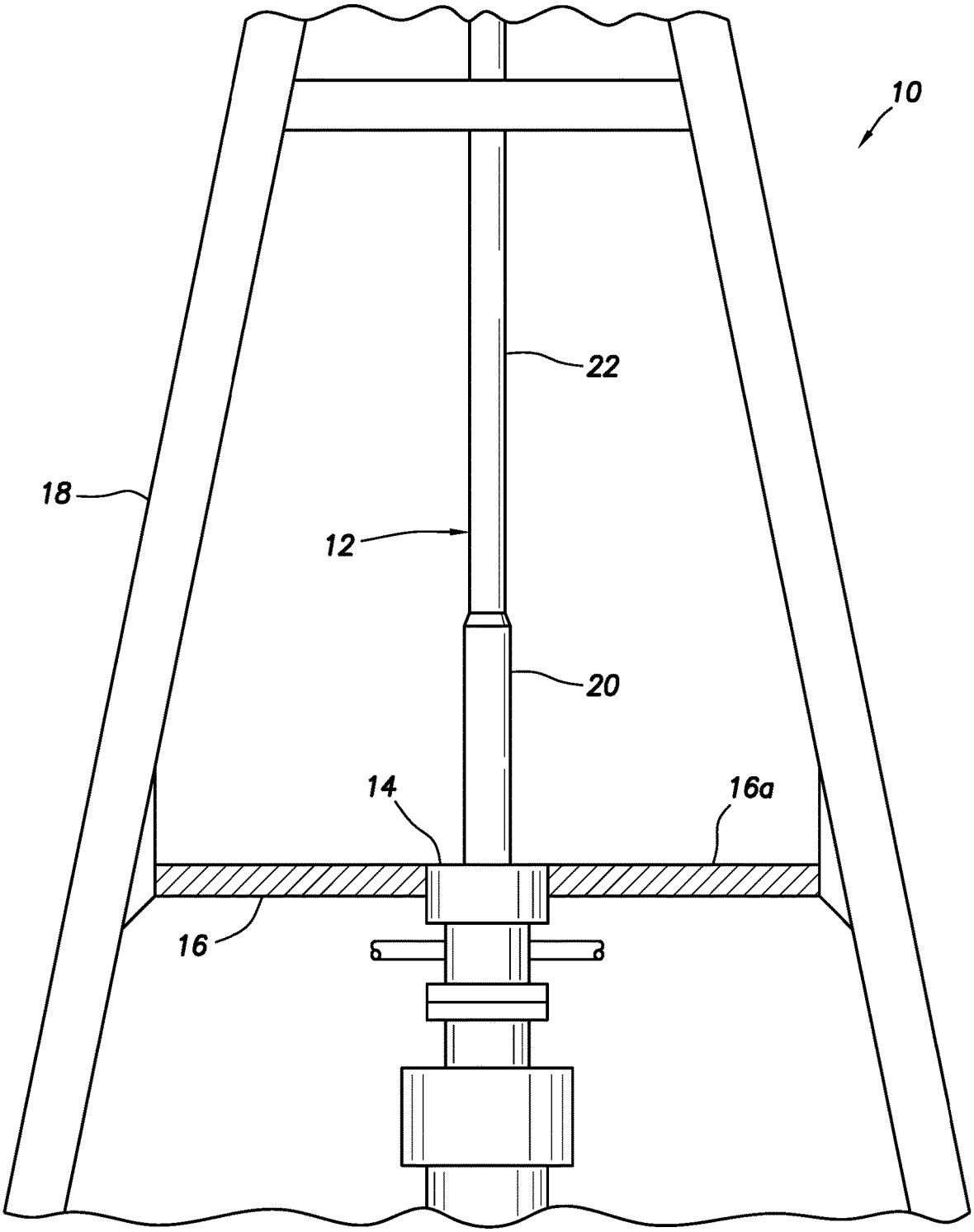
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12, which includes multiple pieces of pipe, is suspended over and in a borehole (not visible in FIG. 1) by a spider 14. Spider 14 is configured to grip multiple sizes of elongate well components, such as tubular members, including pipe. The tubular string 12 could also be suspended by means of an elevator or a top drive in various examples. The scope of this disclosure is not limited to any particular equipment used in conjunction with the spider 14.

The spider 14 is incorporated into a rig floor 16 of a well rig 18 (such as, a land-based or a water-based drilling rig, etc.). In this example, the spider 14 is mounted in the rig floor 16 so that it is flush with an upper surface 16*a* of the rig floor. In this manner, the spider 14 does not present a tripping hazard to personnel working on the rig floor 16. However, in other examples, the spider 14 is not necessarily flush with an upper surface of a rig floor.

The tubular string 12 includes multiple well components 20, 22 having respective different diameters. In this example, the well component 20 could be part of a bottom hole assembly and the well component 22 could be a tubular (such as, a section of drill pipe, tubing, liner or casing). However, the scope of this disclosure is not limited to use of any particular type or combination of well components with the spider 14.

Figure 2:
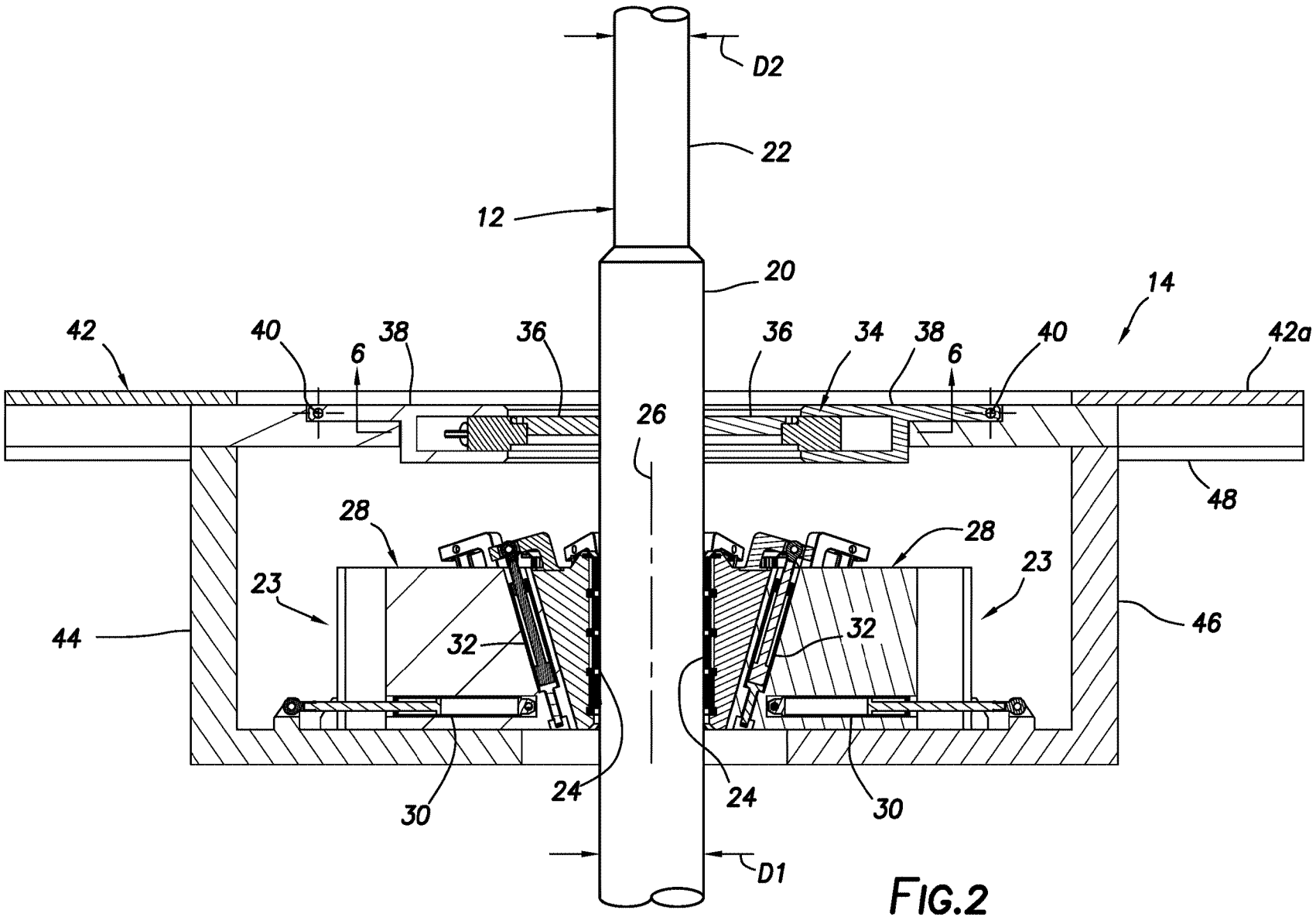
FIG. 2 is a representative partially cross-sectional view of an example of a spider being used to suspend a well component in accordance with the principles of this disclosure.

Referring additionally now to FIG. 2, a cross-sectional view of an example of the spider 14 is representatively illustrated. In this view, it may be seen that the spider 14 includes multiple slip assemblies 23 including respective multiple slips 24 that grip an outer surface of the well component 20. The slip assemblies 23 are circumferentially distributed about a central axis 26 of the spider 14. The central axis 26 is preferably aligned with a central axis of the borehole into which the tubular string 12 is deployed.

In this example, it is desired for the slips 24 to also be able to effectively grip an outer surface of the well component 22. However, the well components 20, 22 have substantially different outer diameters D1, D2. In contrast, in a conventional spider, the slips are generally configured to effectively grip only a relatively narrow range of well component diameters.

The spider 14 example of FIG. 2, however, includes features that solve this problem in a unique manner. These features include the use in the slip assemblies 23 of respective independent slip carriers 28 that are radially displaceable relative to the central axis 26. Each slip carrier 28 is provided with a slip carrier actuator 30 to displace the slip carrier between a radially inwardly extended position and a radially outwardly retracted position. The extended and retracted positions may be any or multiple extreme or intermediate positions based on the extent of travel of the slip carrier actuators 30. The slip carrier actuators 30 can comprise hydraulic or pneumatic cylinders, electrical actuators, power screws, or any other suitable type of actuator.

Each slip carrier 28 is also provided with a slip actuator 32. The slip actuators 32 can comprise hydraulic or pneumatic cylinders, electrical actuators, power screws, or any other suitable type of actuator. The slip actuators 32 displace the slips 24 to raised and lowered positions relative to the slip carriers 28. The slip actuators 32 may also displace the slips 24 to intermediate positions (between the raised and lowered positions) in some examples.

In the raised position, the slips 24 are disengaged from a well component positioned in the spider 14. In the lowered position, the slips 24 can engage and grip a well component positioned in the spider 14.

In this example, the raised position is an uppermost position of the slips 24, at which the slip actuators 32 are at their maximum extent. The slips 24 can be positioned at the raised, uppermost position whether or not a well component is positioned in the spider 24.

In an intermediate position (between the raised and lowered positions), the slips 24 may or may not engage a well component positioned in the spider 24. The size of the well component, the positions of the slip carriers 28 and the configurations of the slips 24 can affect whether the slips engage a particular well component at a particular position of the slips relative to the slip carriers.

As depicted in FIG. 2, the lowered position of the slips 24 is a lowermost position of the slips, at which the slip actuators are at their minimum extent. However, if a well component having a sufficient size is positioned in the spider 14, the slips 24 will engage and grip the well component before the slips reach the lowermost position. Thus, when the slips 24 are gripping a well component positioned in the spider 14, the lowered position of the slips can be somewhat above the lowermost position.

In the FIG. 2 example, the slip carriers 28 are radially extended (radially inwardly displaced) by the slip carrier actuators 30, and the slips 24 are lowered by the slip actuators 32. In this configuration, the slips 24 are capable of gripping and suspending the well component 20. To release the well component 20 for vertically downward displacement relative to the spider 14, the tubular string 12 can be picked up (e.g., by use of a rig elevator or top drive), and then the slips 24 can be raised by the slip actuators 32, so that they are no longer in gripping engagement with the well component.

The spider 14 example of FIG. 2 also includes a pipe guide assembly 34 that helps to maintain the tubular string 12 aligned with the central axis 26 (such as, when the slips 24 are not engaged with the tubular string). The pipe guide assembly 34 in this example includes multiple pipe guides 36 that are rotatable to vary a size of an opening between the pipe guides (see FIGS. 6A & B).

In the FIG. 2 example, the pipe guide assembly 34 is incorporated into covers 38 that are pivotable about axes 40 relative to a table assembly 42 of the spider 14. By pivoting the covers 38 upward about the axes 40, convenient access to the slips 24 and slip carriers 28 within the table assembly 42 is obtained (see FIG. 7).

The table assembly 42 in this example includes laterally separable body sections 44, 46 that contain the slip assemblies 23. The body sections 44, 46 are laterally displaceable along channels or rails 48 (only one of which is visible in FIG. 2). The rails 48 can be supported by, for example, beams of the rig floor 16 (see FIG. 1), so that an upper surface 42*a* of the table assembly 42 is flush with (horizontally aligned with, in this example) the upper surface 16*a* of the rig floor 16.

Figure 4:
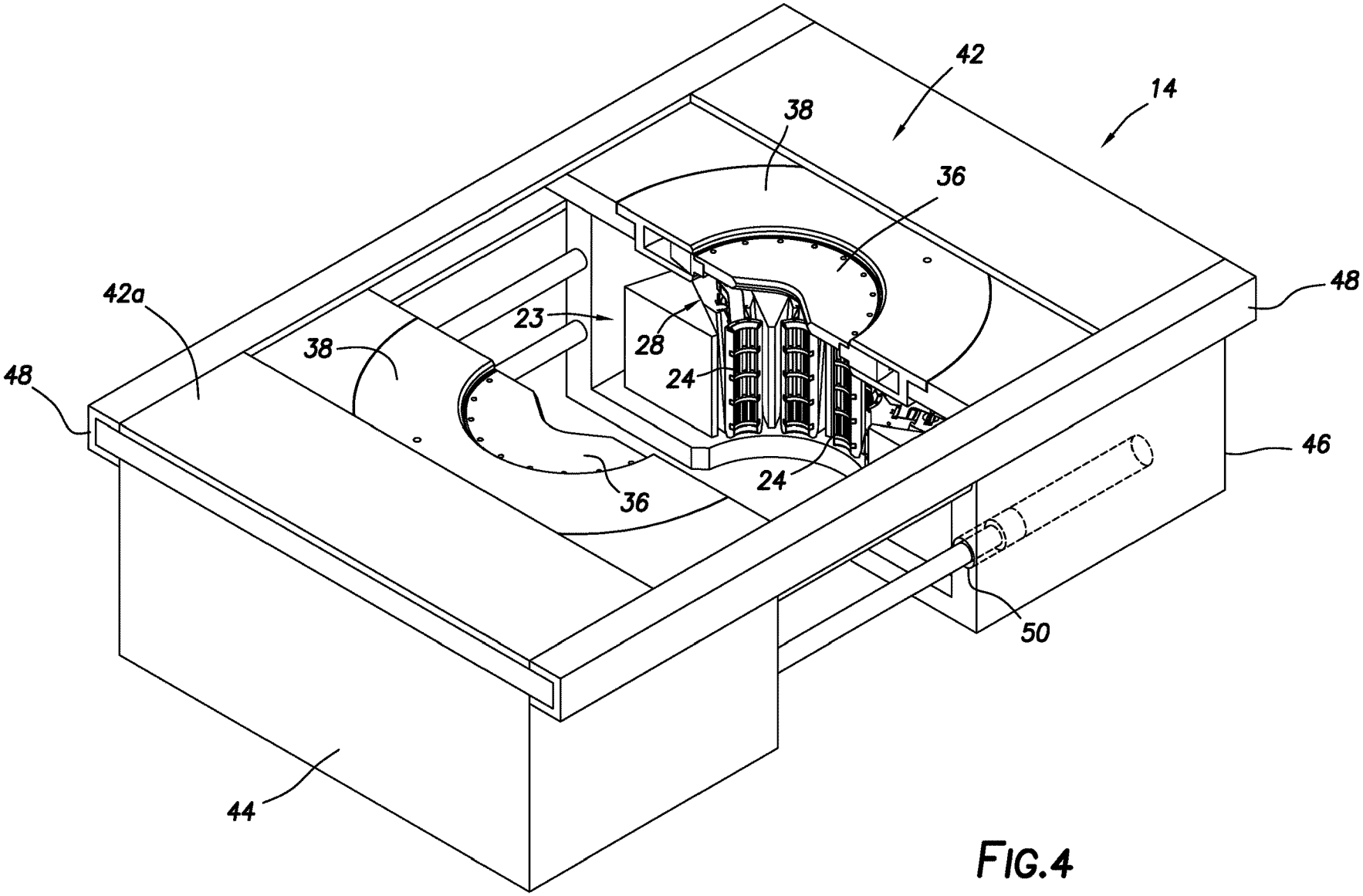
FIG. 4 is a representative isometric view of the spider of FIG. 2 with the table assembly in an open configuration.
Figure 5B:
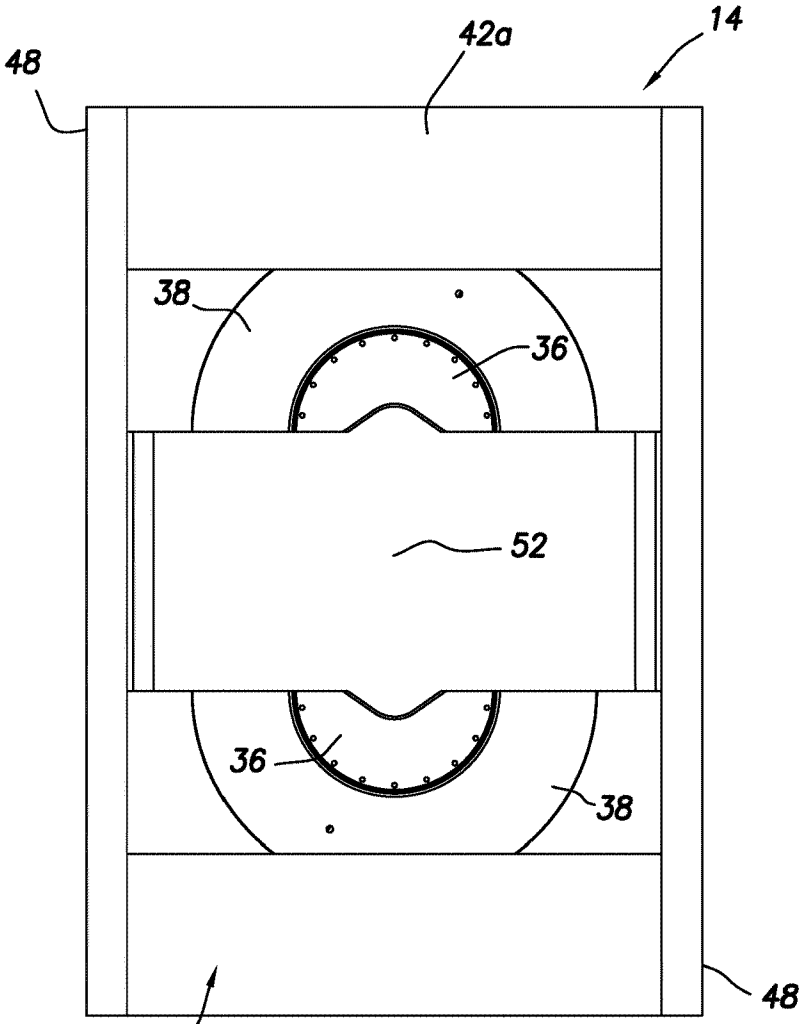
FIGS. 5A & B are representative top views of the spider of FIG. 2 with the table assembly in the respective closed and open configurations.

When it is desired to pass a substantially large component or item of equipment (such as, a conductor pipe, riser section, blowout preventer, etc.) through the spider 14, the body sections 44, 46 can be laterally separated from each other (see FIGS. 4-5B). Since the slip assemblies 23 are mounted in the respective body sections 44, 46, the slip assemblies are also laterally separated, so that the large component or item of equipment can conveniently fit between the body sections and slip assemblies.

Although the spider 14 example of FIG. 2 is described herein and is depicted in the drawings as incorporating certain features that solve certain problems in the pipe handling art, it should be clearly understood that the scope of this disclosure is not limited to use of any particular feature or combination of features in a spider, and is not limited to solving any particular problem or combination of problems. A spider incorporating the principles of this disclosure may comprise any feature or combination of features described herein or depicted in the drawings, and may solve any problem or combination of problems, whether or not the problem(s) is/are described herein.

Figure 3:
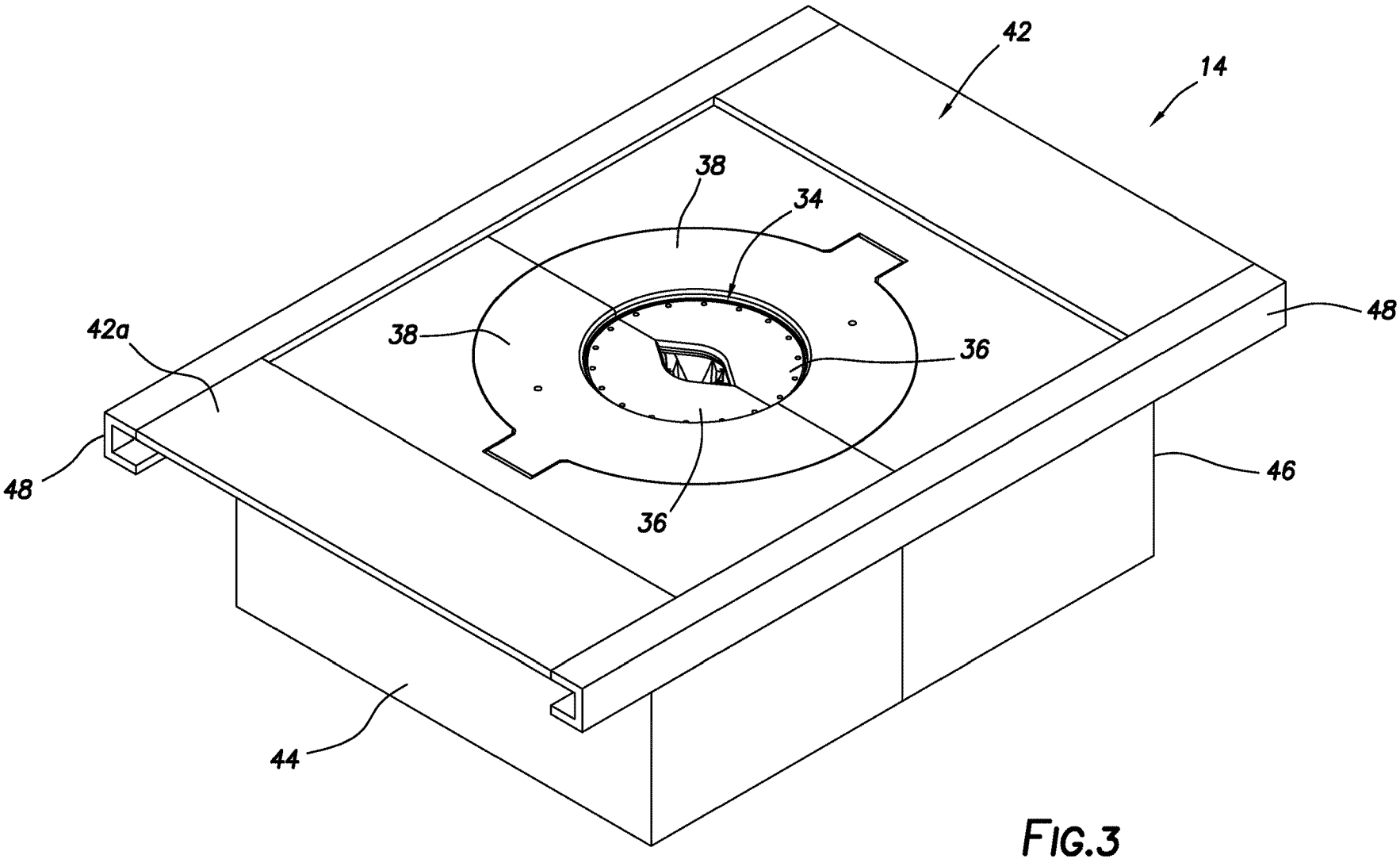
FIG. 3 is a representative isometric view of the spider of FIG. 2 with a table assembly thereof in a closed configuration.

Referring additionally now to FIG. 3, the spider 14 is representatively illustrated without the tubular string 12 therein. In this view, the body sections 44, 46 of the table assembly 42 are in a closed configuration, the covers 38 are in a closed configuration, and the pipe guides 36 are rotated to a minimum opening configuration.

Referring additionally now to FIG. 4, the spider 14 is representatively illustrated with the table assembly 42 in an open configuration. The body sections 44, 46 are laterally separated from each other, thereby separating respective sets of the slips 24 and corresponding slip carriers 28. A relatively large well component or item of equipment can now be displaced through the spider 14.

Body section actuators 50 are used to laterally displace the body sections 44, 46 toward and away from each other. The body section actuators 50, as well as the slip actuators 32 and slip carrier actuators 30 described above, could be hydraulically, electrically or otherwise activated.

For example, hydraulic actuators, electrical actuators or power screws may be used in different examples. As another example, a rack and pinion system could be implemented with a motor (hydraulic/electric/pneumatic) to separate the body sections 44 and 46 instead of using an actuator. The rack could be mounted on the body halves 44 and 46, and the motors could be mounted on the rails 48. The scope of this disclosure is not limited to use of any particular type of actuator for any of the actuators described herein or depicted in the drawings.

Figure 5A:
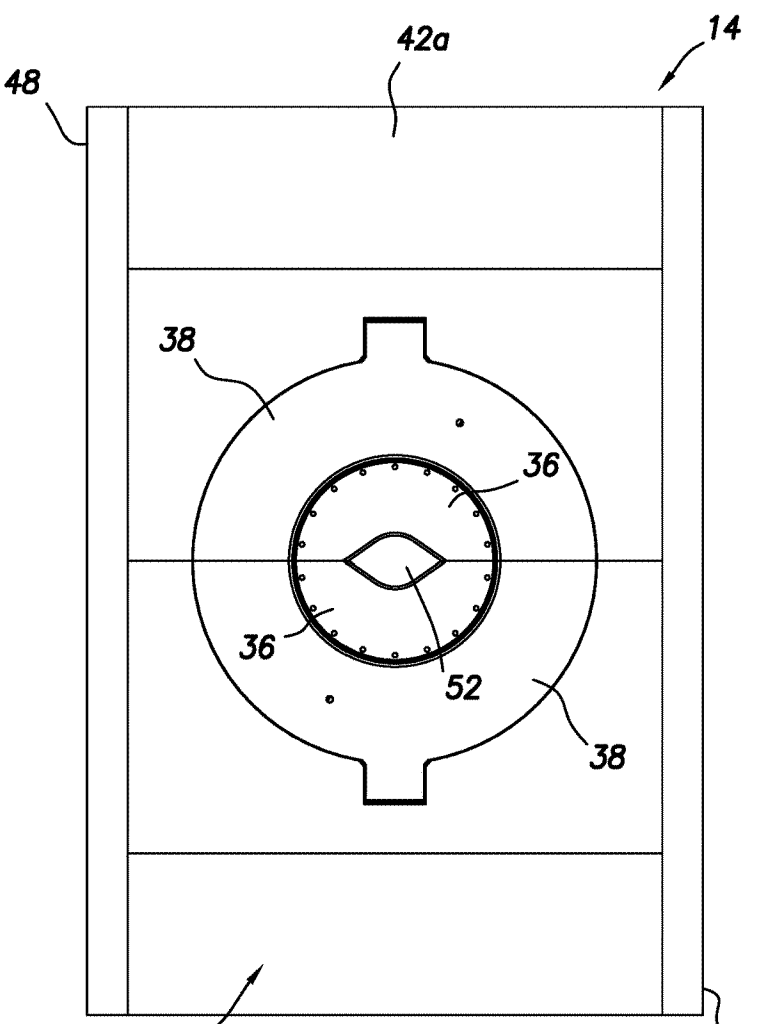

Referring additionally now to FIGS. 5A & B, the spider 14 is representatively illustrated with the table assembly 42 in respective closed and open configurations. In these views, a very large difference is apparent between the size of an opening 52 between the pipe guides 36 in the closed configuration, and the size of the opening in the open configuration.

In some examples, it is expected that the opening 52 in the open configuration can allow a well component or item of equipment having a width or diameter of up to 80 inches (~203 cm) to pass through the spider 14. However, the scope of this disclosure is not limited to the spider 14 allowing a well component or item of equipment having a width or diameter of up to 80 inches (~203 cm) to pass through the spider.

Figure 6B:
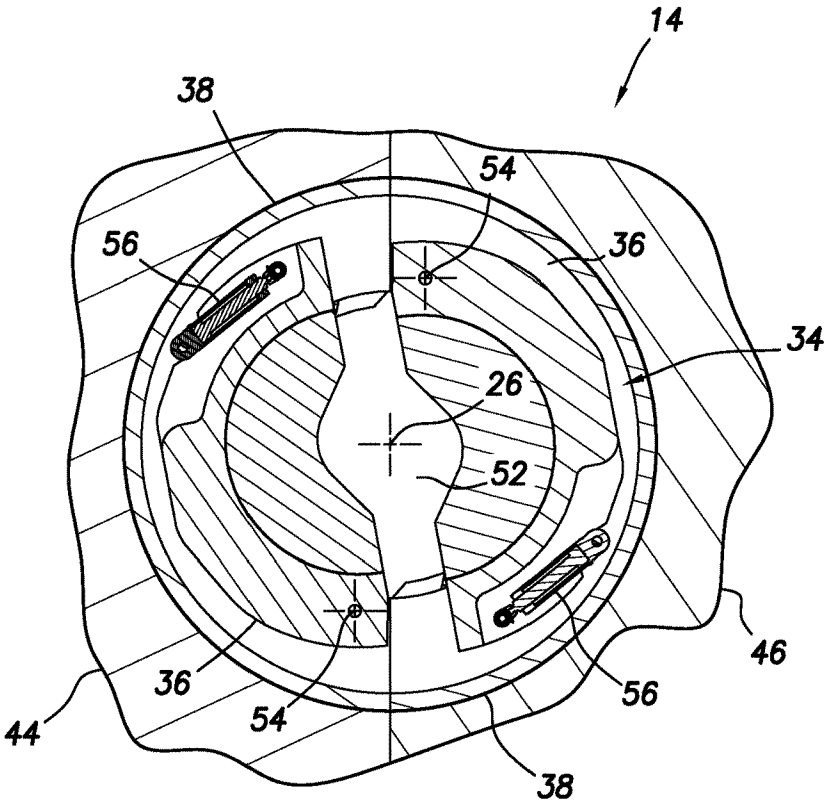
FIGS. 6A & B are representative cross-sectional views, taken along line 6-6 of FIG. 2, of a pipe guide assembly of the spider of FIG. 2 in respective minimum opening and maximum opening configurations.
Figure 6A:
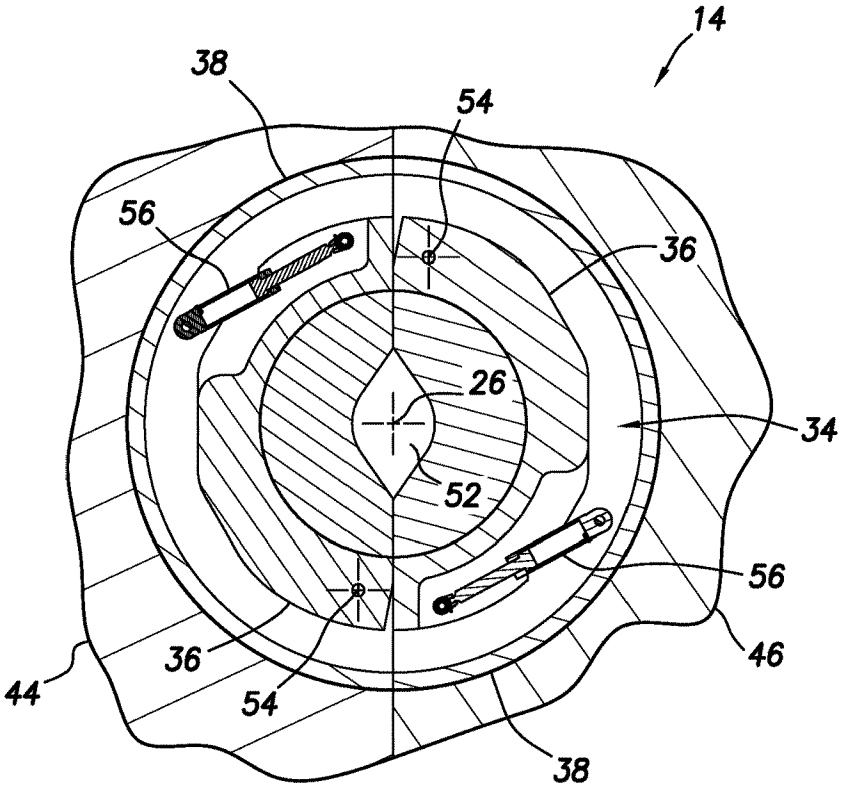

Referring additionally now to FIGS. 6A & B, cross-sectional views of the pipe guide assembly 34 of the spider 14, taken along line 6-6 of FIG. 2, are representatively illustrated. In FIG. 6A, the pipe guide assembly 34 is in a minimum open configuration. In FIG. 6B, the pipe guide assembly 34 is in a maximum open configuration.

The maximum open configuration will accommodate a larger well component between the pipe guides 36 as compared to the minimum open configuration. For example, the maximum open configuration of FIG. 6B may accommodate the larger diameter well component 20 (see FIGS. 1 & 2) in the opening 52, and the minimum open configuration of FIG. 6A may accommodate the smaller diameter well component 22 in the opening 52.

The pipe guides 36 are rotated about respective pipe guide axes 54 between their minimally open and maximally open positions by respective pipe guide actuators 56. The pipe guide axes 54 are parallel to the central axis 26, so that the pipe guides 36 rotate in a plane that is orthogonal to the central axis.

However, the scope of this disclosure is not limited to any particular orientation of the axes 54, or to rotation of the pipe guides 36 at all. In other examples, the pipe guides 36 could be displaced relative to each other without any rotation (e.g., the pipe guide actuators 56 could laterally displace the pipe guides without rotating the pipe guides).

Figure 7:
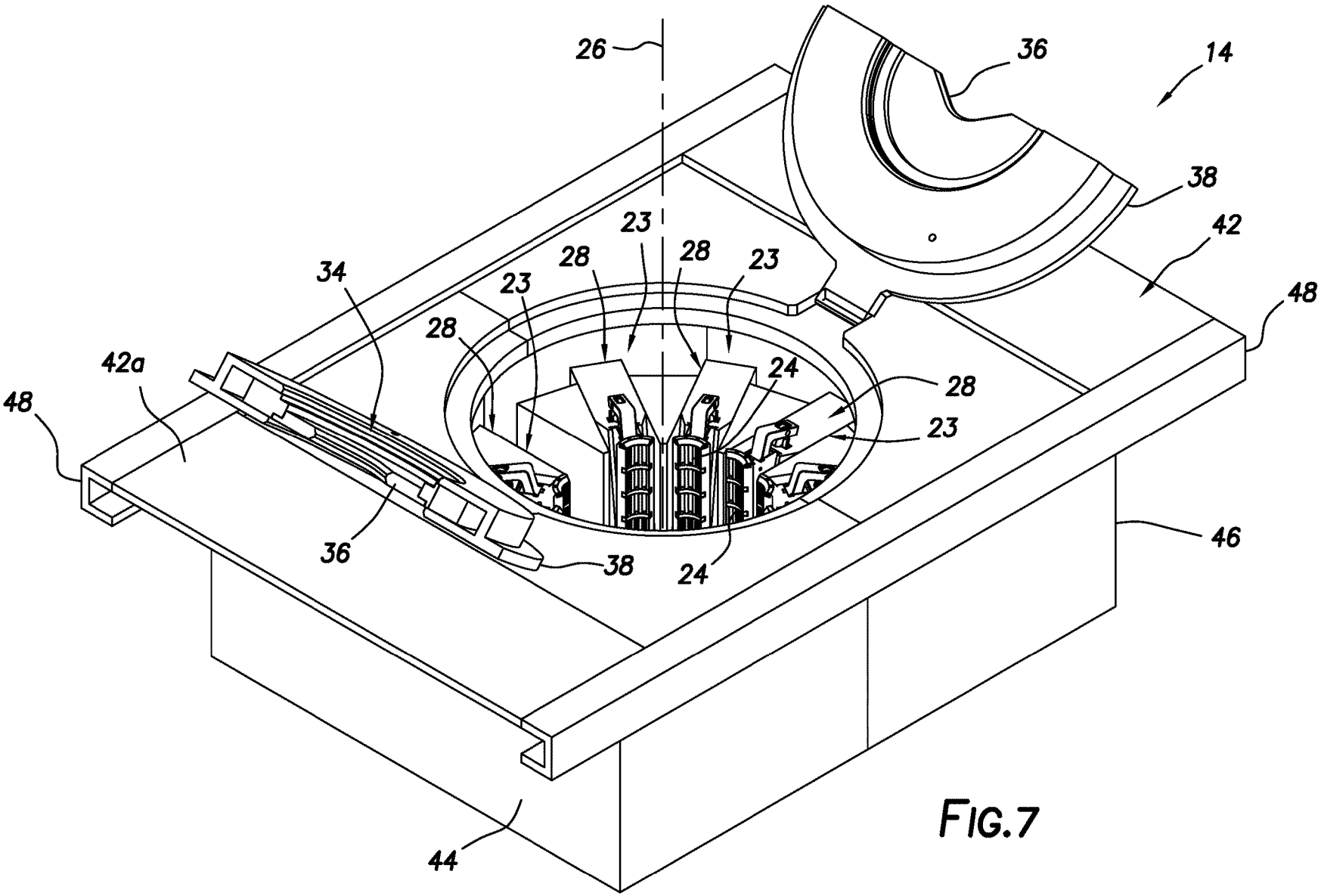
FIG. 7 is a representative isometric view of the spider of FIG. 2 with covers thereof in an open configuration.

Referring additionally now to FIG. 7, the spider 14 is representatively illustrated with the covers 38 in a fully open configuration. In this configuration, the slips 24 and slip carriers 28 in the table assembly 42 are conveniently accessible, for example, to inspect, repair, maintain or replace these or other components of the spider 14.

In this example, each of the covers 38 is pivotable more than 90 degrees from a closed position (see FIG. 3) to an open position as depicted in FIG. 7. This enhances access to the slips 24, slip carriers 28 and other components in the table assembly 42. In the closed position, the covers 38 are oriented orthogonal to the central axis 26, and in the open position, the covers are inclined upwardly and outwardly relative to the central axis.

However, the scope of this disclosure is not limited to any particular orientation of the covers 38 in either of the open or closed positions. For example, the covers 38 could be oriented parallel to the central axis 26 in the open position.

In some examples, the covers 38 can be actuated between the open and closed positions using a motor or other actuator (not shown), thereby enabling remote operation. Alternatively, the covers 38 can be manually opened or closed by a rig crew member using a crane or other lifting device.

Figure 8:
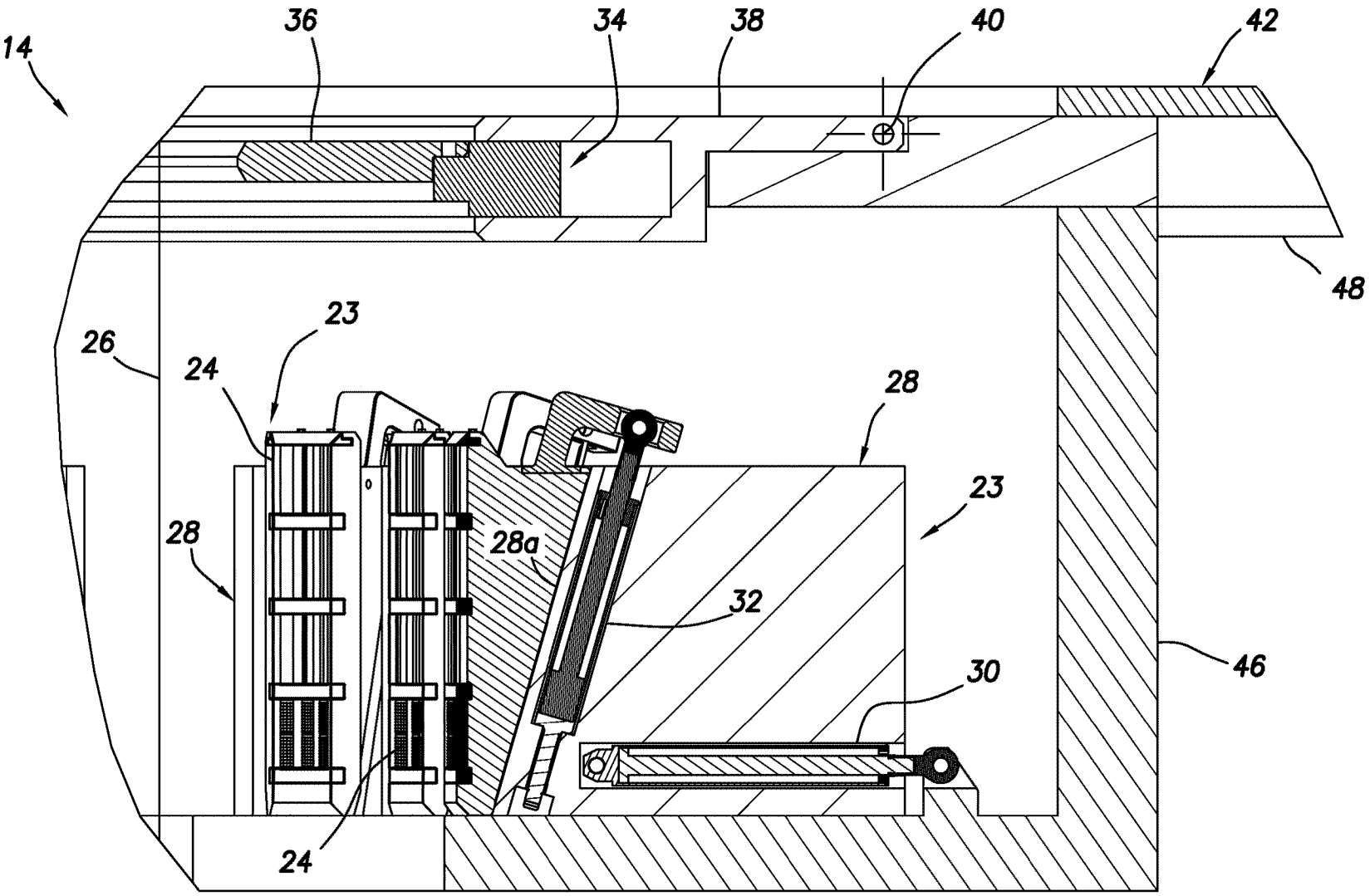
FIG. 8 is a representative cross-sectional view of a portion of the spider of FIG. 2, taken along line 8-8 of FIG. 14, with slips thereof in a lowered position, and with slip carriers thereof in a radially retracted position.
Figure 14:
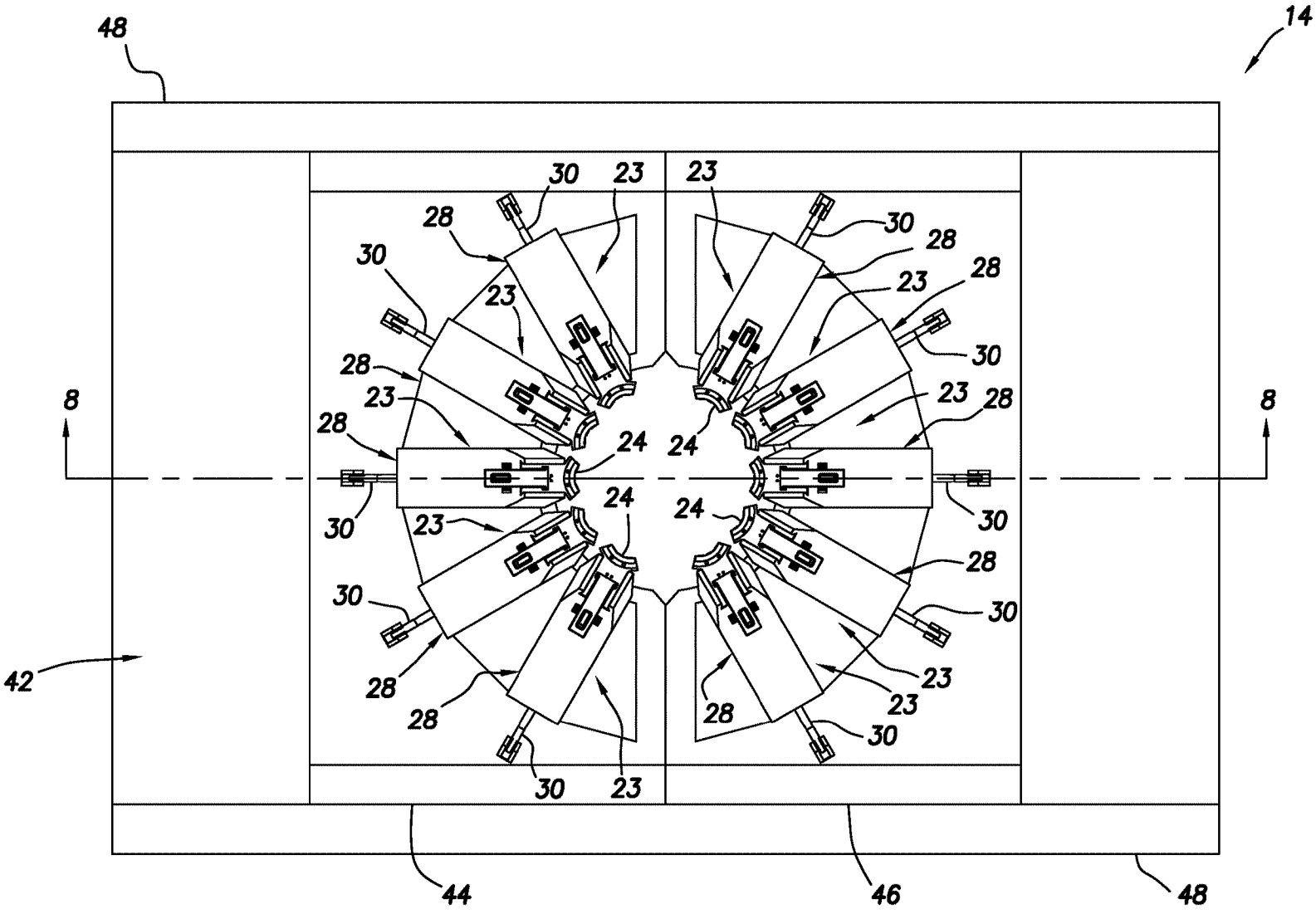
FIG. 14 is a representative top view of the spider of FIG. 2 with the covers removed, with ten of the slip carriers in the radially extended position, and with the corresponding slips in the lowered position.

Referring additionally now to FIG. 8, a cross-sectional view of a portion of the spider 14, taken along line 8-8 of FIG. 14, is representatively illustrated. In this view, the slips 24 are in a lowered position, and the slip carriers 28 are in a radially retracted position.

The slip actuators 32 can be activated to raise the slips 24 when desired. Note that the slip actuators 32 displace the slips 24 along respective inclined surfaces 28*a* of each slip carrier 28. Dovetail profiles (or other types of interlocking profiles) may be formed on the surfaces 28*a* to retain the slips 24 on the slip carriers 28 while permitting displacement of the slips along the surfaces 28*a*. Note, also, that the slip actuators 32 are oriented parallel to the respective slip carrier surfaces 28*a* in this example.

Because the surfaces 28*a* are inclined upwardly and outwardly relative to the central axis 26, when the slip actuators 32 raise the slips 24, the slips will also displace radially outwardly. Thus, raising of the slips 24 can be used to displace the slips out of gripping engagement with a well component previously suspended in the spider 14, or to otherwise increase a radial distance between the slips.

Figure 9:
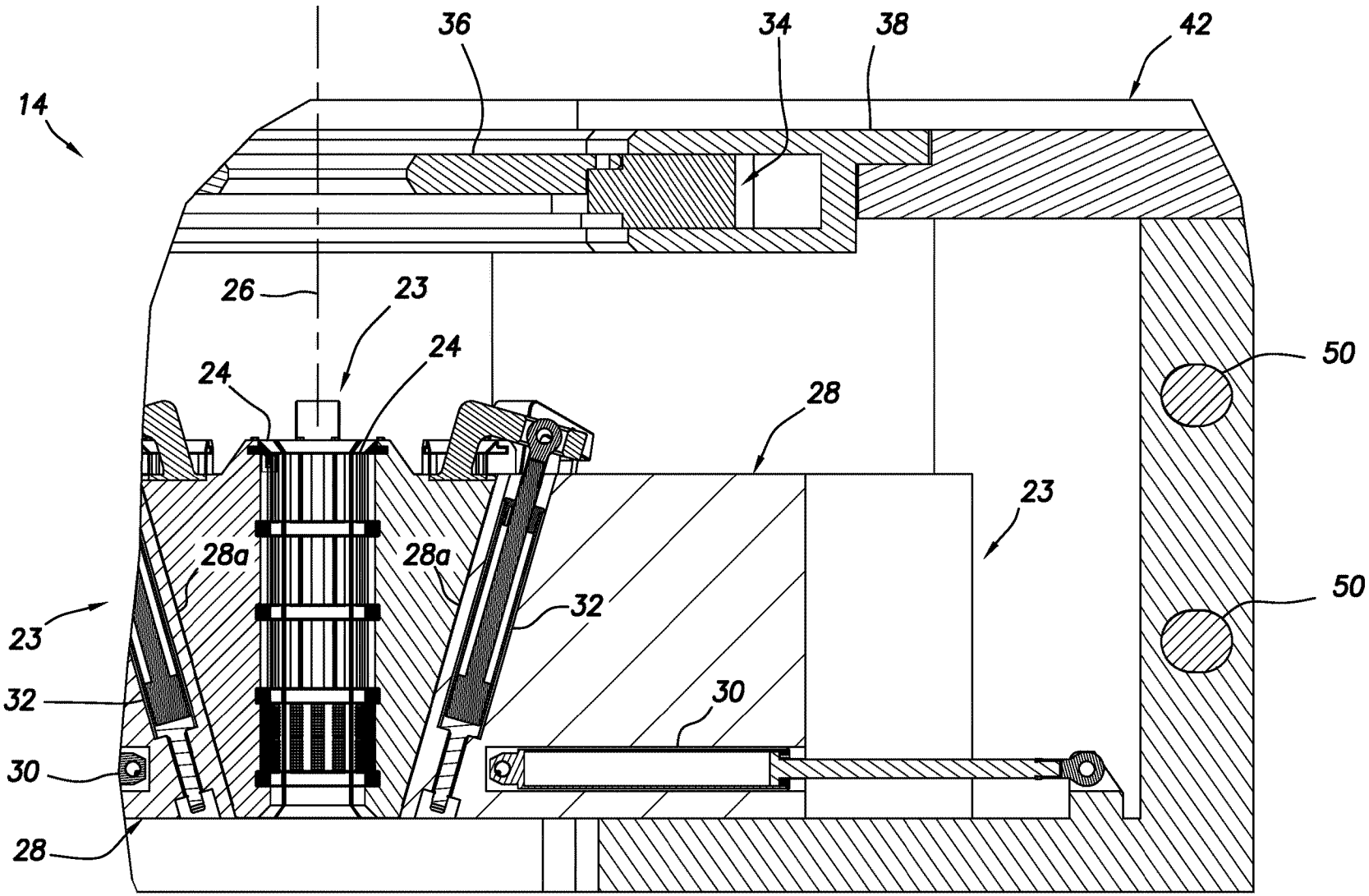
FIG. 9 is a representative cross-sectional view of a portion of the spider of FIG. 2, taken along line 9-9 of FIG. 12, with slips thereof in the lowered position, and with slip carriers thereof in a radially extended position.
Figure 12:
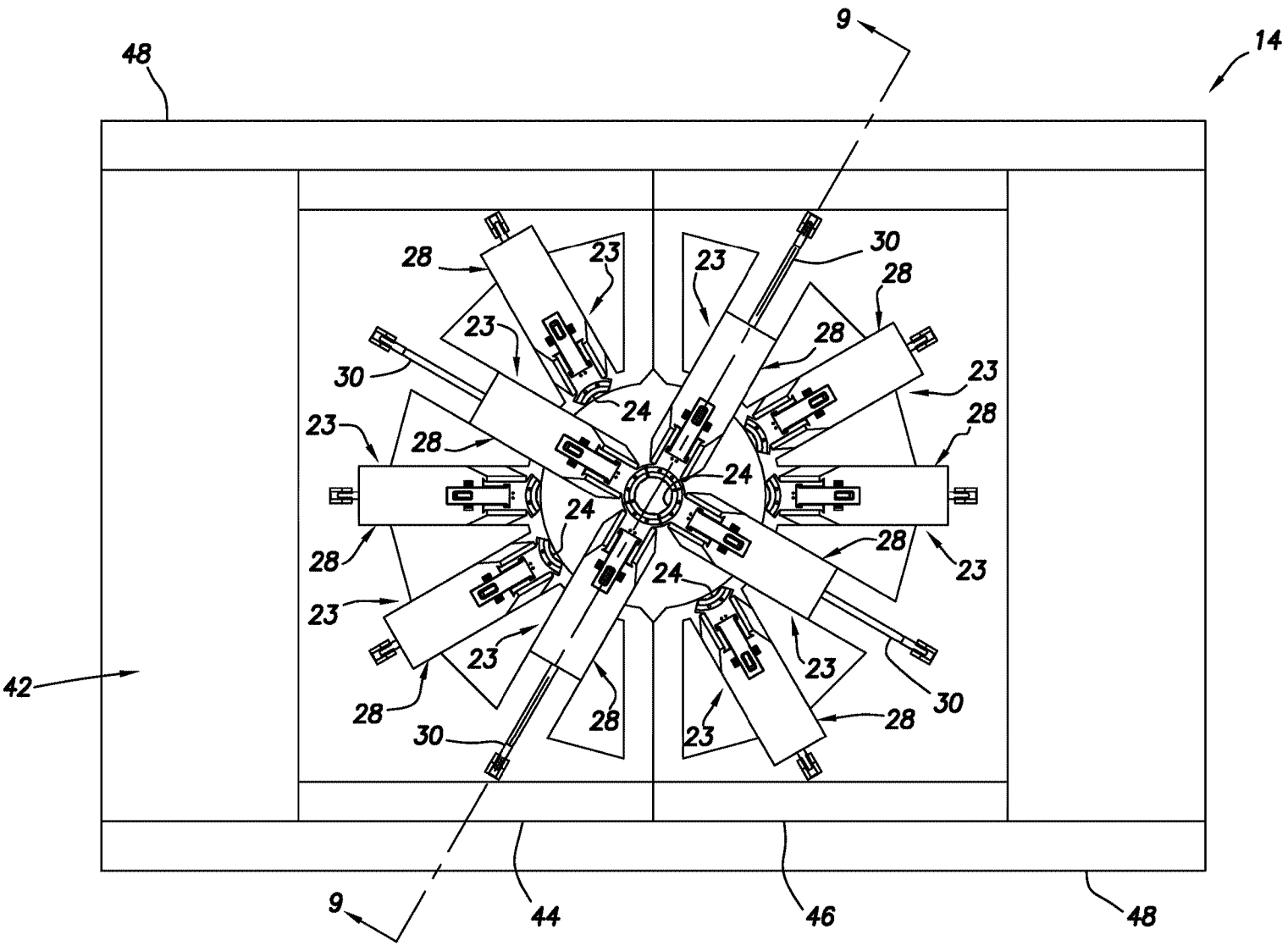
FIG. 12 is a representative top view of the spider of FIG. 2 with the covers removed, with four of the slip carriers in the radially extended position, and with the corresponding slips in the lowered position.

Referring additionally now to FIG. 9, a cross-sectional view of a portion of the spider 14, taken along line 9-9 of FIG. 12, is representatively illustrated. In this view, the slips 24 are in their lowered positions. In addition, the slip carriers 28 are in their radially inwardly extended positions.

In these positions of the slips 24 and slip carriers 28, a well component can be effectively gripped and suspended by the slips of the spider 14. As described more fully below, a set of only four of the slips 24 and slip carriers 28 are displaced to their respective lowered and radially extended positions in this example (see FIG. 12), so that a relatively small diameter well component can be effectively gripped by the four slips.

Figure 10:
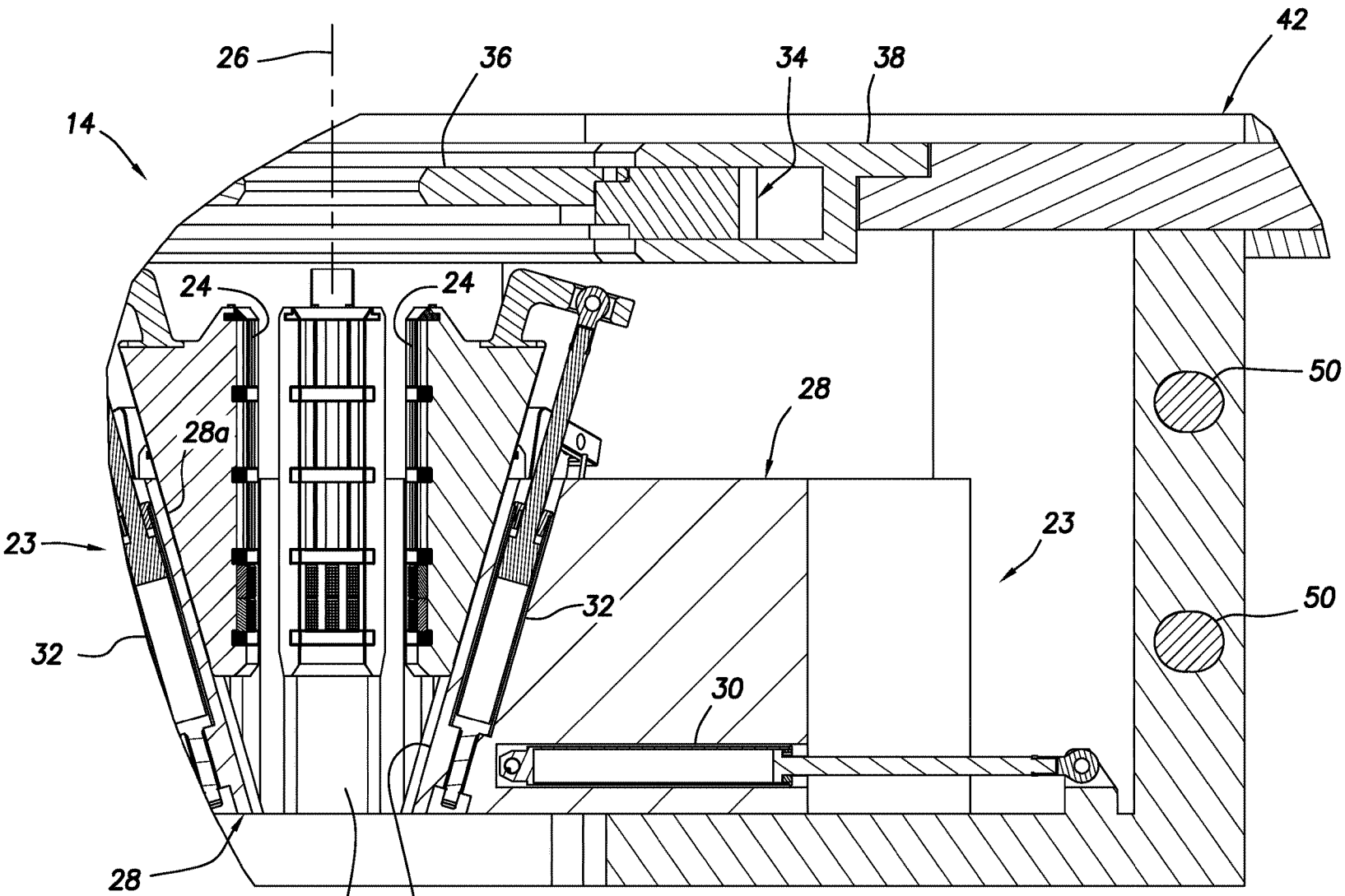
FIG. 10 is a representative cross-sectional view of a portion of the spider of FIG. 2, taken along line 10-10 of FIG. 11, with slips thereof in a raised position, and with slip carriers thereof in a radially extended position.
Figure 11:
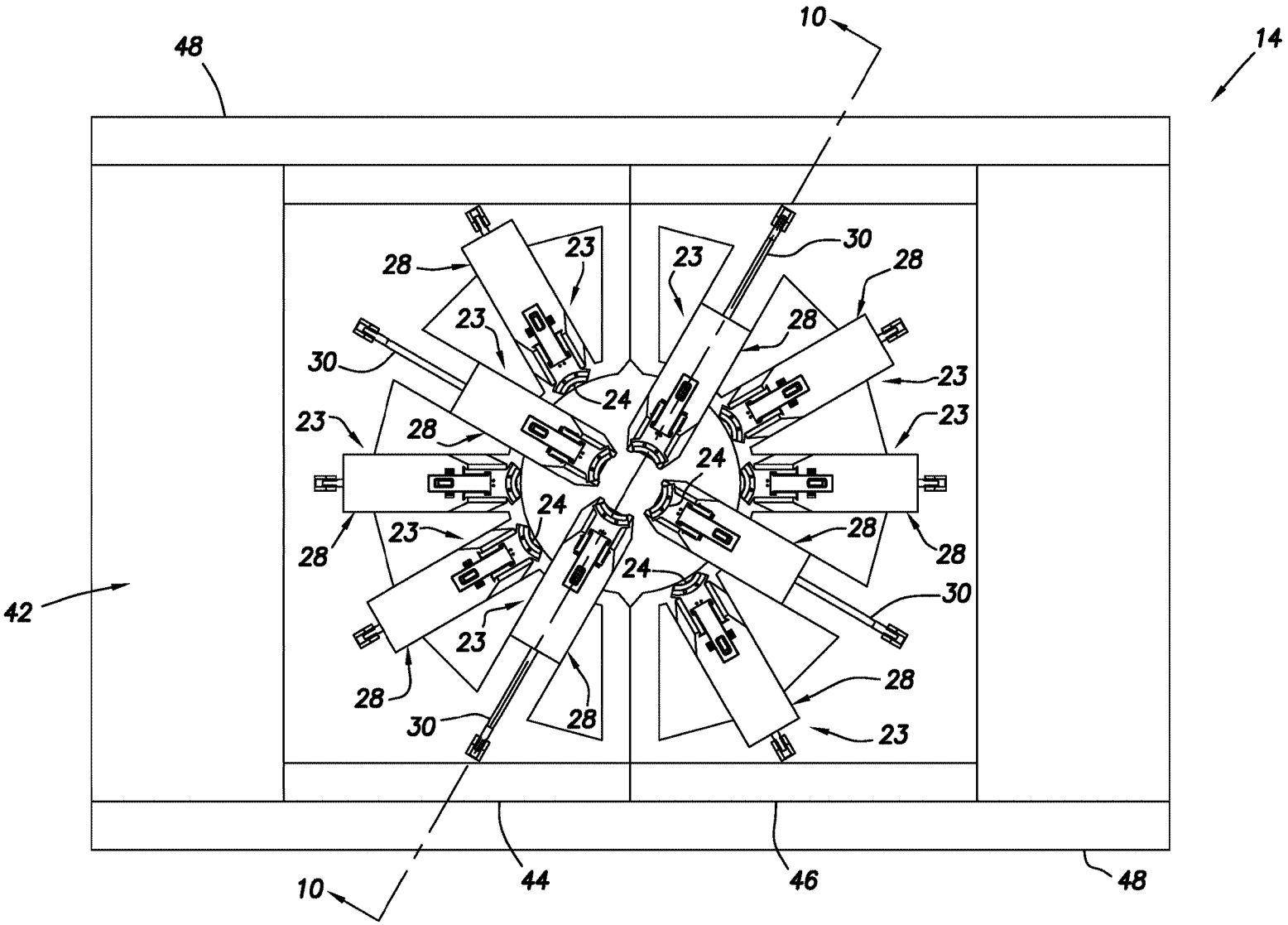
FIG. 11 is a representative top view of the spider of FIG. 2 with the covers removed, and with four of the slip carriers in the radially extended position, and with the corresponding slips in the raised position.

Referring additionally now to FIG. 10, a cross-sectional view of a portion of the spider 14, taken along line 10-10 of FIG. 11, is representatively illustrated. In this view, the slips 24 are in their raised positions. The slip carriers 28 remain in their radially inwardly extended positions.

In these positions of the slips 24, the slips are displaced radially outward relative to their FIG. 9 positions. Thus, the slips 24 would be disengaged from a well component positioned in the spider 14. However, since the slip carriers 28 are in their radially inwardly extended positions, the slips 24 can be readily engaged with the well component by activating the slip actuators 32 to displace the slips toward their FIG. 9 lowered positions.

Referring additionally now to FIG. 11, a top view of the spider 14 is representatively illustrated with the covers 38 removed. In this view, it may be seen that a set of four of the slip carriers 28 are in their radially inwardly extended positions, and the corresponding four slips 24 are in their raised positions.

In this example, the spider 14 is configured to accommodate a relatively small diameter well component therein. However, since the set of four slips 24 are in their raised positions, the slips will not grippingly engage the relatively small diameter well component. Note that two of the set of four slips 24 and slip carriers 28 are disposed in the body section 44 of the table assembly 42, and the other two of the set of four slips and slip carriers are disposed in the body section 46 of the table assembly.

Referring additionally now to FIG. 12, a top view of the spider 14 is representatively illustrated with the covers 38 removed. In this view, it may be seen that the set of four of the slip carriers 28 are in their radially inwardly extended positions. In addition, the corresponding set of four slips 24 are in their lowered positions.

In this configuration, the spider 14 is able to grip and suspend the relatively small diameter well component therein. With the set of four slips 24 in their lowered positions, the slips will grippingly engage the relatively small diameter well component.

Figure 13:
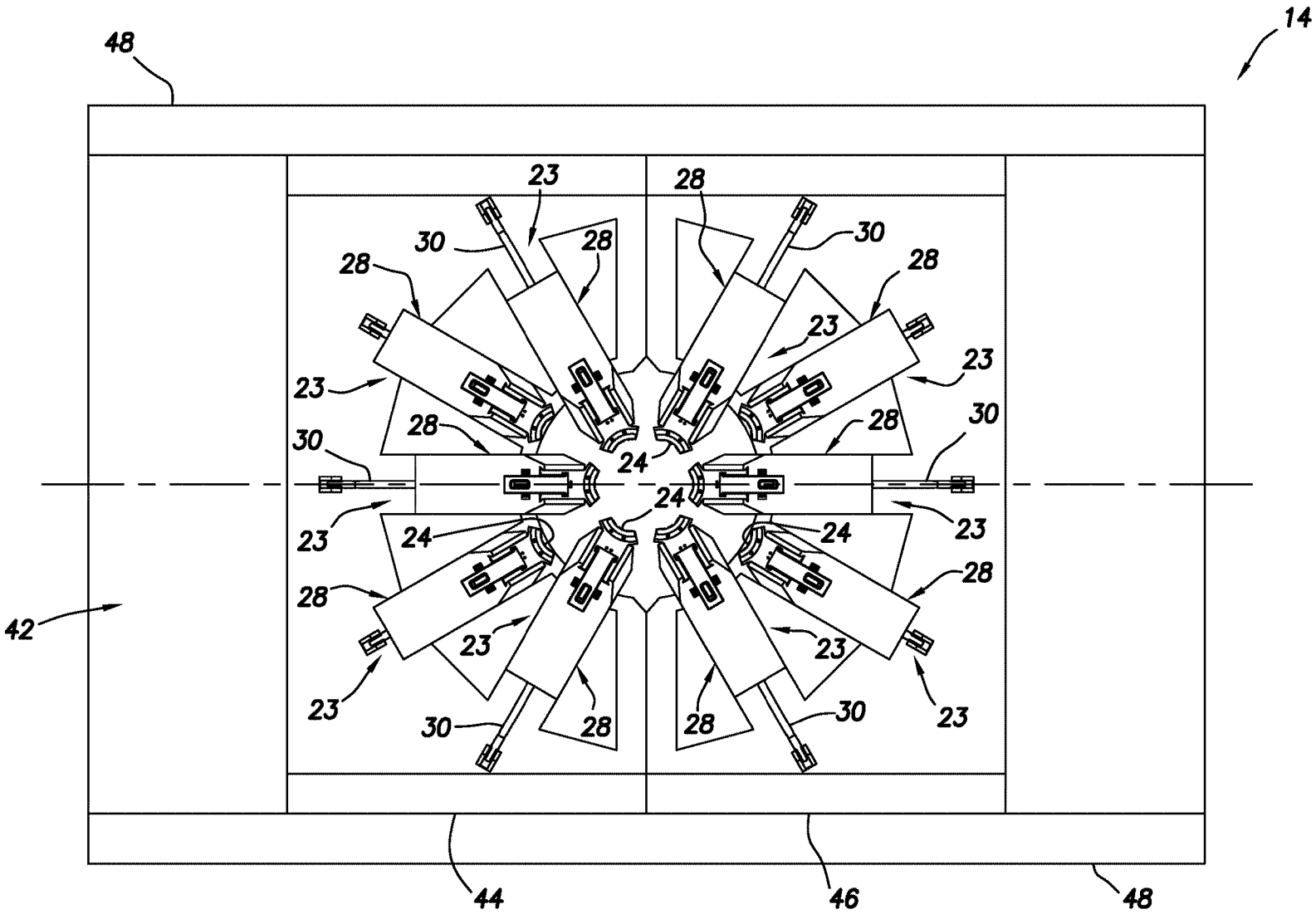
FIG. 13 is a representative top view of the spider of FIG. 2 with the covers removed, with six of the slip carriers in the radially extended position, and with the corresponding slips in the lowered position.

Referring additionally now to FIG. 13, a top view of the spider 14 is representatively illustrated with the covers 38 removed. In this view, a set of six of the slip carriers 28 are in their radially inwardly extended positions, and the corresponding six slips 24 are in their lowered positions.

In this example, the spider 14 is configured to accommodate an intermediate diameter well component therein. To grip the intermediate diameter well component when it is positioned in the spider 14, the corresponding six slip actuators 32 (see FIG. 8) are activated to displace the set of six slips 24 to their lowered positions. When it is no longer desired to grip the intermediate diameter well component, the set of six slips 24 can be displaced to their raised positions by activation of the respective slip actuators 32.

Note that three of the set of six slips 24 and slip carriers 28 are disposed in the body section 44 of the table assembly 42, and the other three of the set of six slips and slip carriers are disposed in the body section 46 of the table assembly. Furthermore, note that the slip carriers 28 are not radially inwardly displaced as far as the slip carriers in the FIGS. 11 & 12 example. This is because the well component to be gripped and suspended in the FIG. 13 example has a larger diameter as compared to the relatively small diameter well component to be gripped and suspended in the FIGS. 11 & 12 example (e.g., the larger diameter D1 of the well component 20 as compared to the smaller diameter D2 of the well component 22, see FIG. 2).

Referring additionally now to FIG. 14, a top view of the spider 14 with the covers 38 removed is representatively illustrated. In this view, a set of ten of the slip carriers 28 are in their radially inwardly extended positions, and the corresponding ten slips 24 are in their lowered positions.

In this example, the spider 14 is configured to accommodate a relatively large diameter well component therein. To grip the relatively large diameter well component when it is positioned in the spider 14, the corresponding slip actuators 32 (see FIG. 8) are activated to displace the set of ten slips 24 to their lowered positions. When it is no longer desired to grip the relatively large diameter well component, the set of ten slips 24 can be displaced to their raised positions by activation of the respective slip actuators 32.

Note that five of the set of ten slips 24 and slip carriers 28 are disposed in the body section 44 of the table assembly 42, and the other five of the set of ten slips and slip carriers are disposed in the body section 46 of the table assembly. Furthermore, note that the slip carriers 28 are not radially inwardly displaced as far as the slip carriers in the FIGS. 11-13 examples. This is because the well component to be gripped and suspended in the FIG. 14 example has a larger diameter as compared to the relatively small diameter well component to be gripped and suspended in the FIGS. 11 & 12 example, and as compared to the intermediate diameter well component to be gripped and suspended in the FIG. 13 example.

Although the spider 14 examples described above and depicted in the drawings include up to ten each of the slips 24 and slip carriers 28, in other examples a smaller or larger number of slips and slip carriers may be used. In addition, it is not necessary for half of the total number of slips 24 and slip carriers 28 to be disposed in each of the body sections 44, 46 of the table assembly 42.

For automated, or at least instrumented, control of operation of the spider 14, displacements and/or positions of each of the displaceable components of the spider may be monitored, for example, using appropriate sensors (such as, limit switches, proximity sensors, linear variable displacement sensors, etc.). Each of the slips 24, slip carriers 28, pipe guides 36, covers 38 and body sections 44, 46 may be monitored. Each of the actuators 30, 32, 50, 56 may be equipped with sensors to monitor their state of activation, position and/or displacement.

If desired, a weight indicator or load cell may be incorporated into the spider 14, in order to monitor the weight of any tubular string or well component suspended by the spider. Any, all or any combination of the weight indicator or load cell and the sensors described above may be connected to a control system of the well rig 18 (see FIG. 1).

In some examples, a position of at least one of: the first and second sets of slip carriers 28, slips 24 carried on the first and second sets of slip carriers 28, and a table assembly body section 44, 46 may be sensed using any of a variety of different sensors. Using the sensed position(s), the operation of the well rig 18 can be controlled.

For example, a safety interlock system may be activated in response to the sensed position(s). The safety interlock system could, for example, prevent opening of the spider 14 when an elevator is open, and prevent opening of the elevator when the spider 14 is open.

It may now be fully appreciated that the above disclosure provides significant advancements to the spider design, construction and utilization art. In examples described above, the spider 14 enables a wide variety of different sized well components 20, 22 to be accommodated therein or passed therethrough. The pipe guide assembly 34 helps to maintain the well components 20, 22 centered in the spider 14, and the covers 38 provide for enhanced access to the interior of the table assembly 42.

The above disclosure provides to the art a spider 14 for use with a subterranean well. In one example, the spider 14 can include multiple slip assemblies 23 distributed circumferentially about a central axis 26, with each slip assembly 23 comprising: a) a slip carrier 28 radially displaceable relative to the central axis 26, b) a slip 24 displaceable relative to the slip carrier 28, and c) a slip actuator 32 operable to displace the slip 24 relative to the slip carrier 28. The slip actuator 32 is disposed at least partially internal to the slip carrier 28.

In any of the examples described above:

The slip actuator 32 may be operable to displace the slip 24 along a surface 28*a* of the slip carrier 28. The surface 28*a* of the slip carrier 28 may be angularly offset from the central axis 26. The term "angularly offset" refers to the surface 28*a* being disposed at an angle from the central axis 26, where the angle is greater than zero degrees and less than 90 degrees.

The slip actuator 32 may be oriented parallel to the surface 28*a* of the slip carrier 28.

Each slip assembly 23 may include a slip carrier actuator 30 operable to displace the slip carrier 28 radially relative to the central axis 26.

The spider 14 may include a pipe guide assembly 34 comprising multiple pipe guides 36. Each of the pipe guides 36 may be rotatable about a respective guide axis 54 that is parallel to the central axis 26.

The spider 14 may include a table assembly 42 comprising an upper surface 42*a*. The table assembly 42 may be configured to mount to a well rig 18 with the upper surface 42*a* of the table assembly 42 being flush with a rig floor 16 of the well rig 18.

The table assembly 42 may include first and second body sections 44, 46, and at least one body section actuator 50 operable to vary a lateral separation between the first and second body sections 44, 46. Each of the first and second body sections 44, 46 may contain multiple ones of the slip assemblies 23.

Another spider 14 example described above can comprise multiple slip assemblies 23 distributed circumferentially about a central axis 26, and a pipe guide assembly 34 comprising first and second pipe guides 36, and first and second guide actuators 56. The first guide actuator 56 is operable to rotate the first pipe guide 36 about a first guide axis 54 that is parallel to the central axis 26, and the second guide actuator 56 is operable to rotate the second pipe guide 36 about a second guide axis 54 that is parallel to the central axis 26.

In any of the examples described above:

The spider 14 may include first and second covers 38, with each of the first and second covers 38 being pivotable relative to the central axis 26. The first pipe guide 36 and the first guide actuator 56 may be mounted to the first cover 38, and the second pipe guide 36 and the second guide actuator 56 may be mounted to the second cover 38.

Each of the first and second covers 38 may be pivotable at least 90 degrees relative to the central axis 26. Each of the first and second covers 38 may pivot at least 90 degrees from a closed position to an open position.

The spider 14 may include a table assembly 42. The table assembly 42 may include an upper surface 42*a*. The table assembly 42 may be configured to mount to a well rig 18 with the upper surface 42*a* of the table assembly 42 being flush with a rig floor 16 of the well rig 18.

The table assembly 42 may include first and second body sections 44, 46 and a body actuator 50 operable to vary a lateral separation between the first and second body sections 44, 46. Each of the first and second body sections 44, 46 may contain multiple ones of the slip assemblies 23.

Each slip assembly 23 may include a slip 24, a slip carrier 28, a slip actuator 32 operable to displace the slip 24 relative to the slip carrier 28, and a slip carrier actuator 30 operable to displace the slip carrier 28 radially relative to the central axis 26.

A method of operating a spider 14 is also provided to the art by the above disclosure. In one example, the method can comprise: actuating a first set of slip carrier actuators 30 of the spider 14, thereby displacing a first set of slip carriers 28 radially relative to a first well component 20 having a first diameter D1; and actuating a second set of slip carrier actuators 30 of the spider 14, thereby displacing a second set of slip carriers 28 radially relative to a second well component 22 having a second diameter D2, the first diameter D1 being different from the second diameter D2, and a number of slip carriers 28 in the first set of slip carriers 28 being different from a number of slip carriers 28 in the second set of slip carriers 28.

In any of the examples described above:

The second diameter D2 may be greater than the first diameter D1, and the number of slip carriers 28 in the second set of slip carriers 28 may be greater than the number of slip carriers 28 in the first set of slip carriers 28.

The spider 14 may include laterally separable first and second body sections 44, 46. Half of the number of slip carriers 28 in the first set of slip carriers 28 may be disposed in the first body section 44, and half of the number of slip carriers 28 in the first set of slip carriers 28 may be disposed in the second body section 46.

Half of the number of slip carriers 28 in the second set of slip carriers 28 may be disposed in the first body section 44, and half of the number of slip carriers 28 in the second set of slip carriers 28 may be disposed in the second body section 46.

The spider 14 may include a table assembly 42. The method may include attaching the spider 14 to a well rig floor 16, thereby aligning an upper surface 42*a* of the table assembly 42 with the well rig floor 16.

The method may include actuating a first set of slip actuators 32 of the spider 14, thereby displacing a first set of slips 24 into gripping engagement with the first well component 20; and actuating a second set of slip actuators 32 of the spider 14, thereby displacing a second set of slips 24 into gripping engagement with the second well component 22.

At least one slip 24 of the first set of slips 24 may be included in the second set of slips 24.

Each of the first set of slip actuators 32 may be disposed at least partially internal to a respective one of the first set of slip carriers 28.

The method can include sensing a position of at least one of: the first and second sets of slip carriers 28, slips 24 carried on the first and second sets of slip carriers 28, and a table assembly body section 44, 46; and controlling operation of a well rig 18 in response to the sensed position.

The controlling step can include activating a safety interlock system that prevents opening of the spider 14 when an elevator is open, and that prevents opening of the elevator when the spider 14 is open.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A spider for handling/gripping well components for use with a subterranean well, the spider comprising:

multiple slip assemblies distributed circumferentially about a central axis, each slip assembly comprising:

a) a slip carrier radially displaceable relative to the central axis, b) a slip displaceable relative to the slip carrier, c) a slip actuator operable to displace the slip relative to the slip carrier, the slip actuator being disposed at least partially internal to the slip carrier, and d) a slip carrier actuator operable to displace the slip carrier only in a straight radial direction relative to the central axis.

2. The spider of claim 1, in which the slip actuator is operable to displace the slip along a surface of the slip carrier, the surface of the slip carrier being angularly offset from the central axis.

3. The spider of claim 2, in which the slip actuator is oriented parallel to the surface of the slip carrier.

4. The spider of claim 1, further comprising a pipe guide assembly, the pipe guide assembly comprising multiple pipe guides, each pipe guide being rotatable about a respective guide axis that is parallel to the central axis.

5. The spider of claim 1, further comprising:

a table assembly, the table assembly comprising an upper surface, and in which the table assembly is configured to mount to a well rig with the upper surface of the table assembly being flush with a rig floor of the well rig.

6. The spider of claim 5, in which the table assembly further comprises first and second body sections, and at least one body section actuator operable to vary a lateral separation between the first and second body sections, and each of the first and second body sections containing multiple ones of the slip assemblies.

7. The spider of claim 4, in which the pipe guide assembly comprises first and second pipe guides, and first and second guide actuators, the first guide actuator being operable to rotate the first pipe guide about a first guide axis that is parallel to the central axis, and the second guide actuator being operable to rotate the second pipe guide about a second guide axis that is parallel to the central axis.

8. The spider of claim 7, further comprising first and second covers, each of the first and second covers being pivotable relative to the central axis, the first pipe guide and the first guide actuator being mounted to the first cover, and the second pipe guide and the second guide actuator being mounted to the second cover.

9. The spider of claim 8, in which each of the first and second covers is pivotable at least 90 degrees relative to the central axis.

10. The spider of claim 8, in which each of the first and second covers pivots at least 90 degrees from a closed position to an open position.

11. A method of operating a spider, the method comprising:

actuating a first set of slip carrier actuators of the spider, thereby displacing each of a first set of slip carriers only in a respective straight radial direction relative to a first well component having a first diameter; and actuating a second set of slip carrier actuators of the spider, thereby displacing each of a second set of slip carriers only in a respective straight radial direction relative to a second well component having a second diameter, the first diameter being different from the second diameter, and a number of slip carriers in the first set of slip carriers being different from a number of slip carriers in the second set of slip carriers.

12. The method of claim 11, in which the second diameter is greater than the first diameter, and the number of slip carriers in the second set of slip carriers is greater than the number of slip carriers in the first set of slip carriers.

13. The method of claim 11, in which the spider comprises laterally separable first and second body sections, half of the number of slip carriers in the first set of slip carriers being disposed in the first body section, and half of the number of slip carriers in the first set of slip carriers being disposed in the second body section.

14. The method of claim 13, in which half of the number of slip carriers in the second set of slip carriers is disposed in the first body section, and half of the number of slip carriers in the second set of slip carriers is disposed in the second body section.

15. The method of claim 11, in which the spider comprises a table assembly, and the method further comprises attaching the spider to a well rig floor, thereby aligning an upper surface of the table assembly with the well rig floor.

16. The method of claim 11, further comprising:

actuating a first set of slip actuators of the spider, thereby displacing a first set of slips into gripping engagement with the first well component; and actuating a second set of slip actuators of the spider, thereby displacing a second set of slips into gripping engagement with the second well component.

17. The method of claim 16, in which at least one slip of the first set of slips is included in the second set of slips.

18. The method of claim 16, in which each of the first set of slip actuators is disposed at least partially internal to a respective one of the first set of slip carriers.

19. The method of claim 11, further comprising:

sensing a position of at least one of the group consisting of: the first and second sets of slip carriers, slips carried on the first and second sets of slip carriers, and a table assembly body section; and controlling operation of a well rig in response to the sensed position.

20. The method of claim 19, in which the controlling comprises activating a safety interlock system that prevents opening of the spider when an elevator is open, and that prevents opening of the elevator when the spider is open.

* * * * *